US009222428B2

(12) United States Patent
Noma et al.

(10) Patent No.: US 9,222,428 B2
(45) Date of Patent: Dec. 29, 2015

(54) ENGINE DEVICE

(75) Inventors: Yasuo Noma, Osaka (JP); Taichi Togashi, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 702 days.

(21) Appl. No.: 13/581,650

(22) PCT Filed: Feb. 17, 2011

(86) PCT No.: PCT/JP2011/053389

§ 371 (c)(1),
(2), (4) Date: Aug. 29, 2012

(87) PCT Pub. No.: WO2011/108366

PCT Pub. Date: Sep. 9, 2011

(65) Prior Publication Data

US 2012/0330531 A1 Dec. 27, 2012

(30) Foreign Application Priority Data

Mar. 5, 2010 (JP) ..... 2010-048792

(51) Int. Cl.

| | |
|---|---|
| ***F01N 3/00*** | (2006.01) |
| ***F02D 41/02*** | (2006.01) |
| ***F02D 41/26*** | (2006.01) |
| *F01N 9/00* | (2006.01) |

(52) U.S. Cl.

CPC ..... *F02D 41/029* (2013.01); *F02D 41/263* (2013.01); *F01N 9/002* (2013.01); *F01N 2430/00* (2013.01)

(58) Field of Classification Search

USPC ..... 60/280, 286, 295, 297, 301, 311; 701/102, 103, 112, 115

See application file for complete search history.

(56) References Cited

U.S. PATENT DOCUMENTS

| | | | | |
|---|---|---|---|---|
| 7,181,909 | B2 * | 2/2007 | Sato et al. | 60/297 |
| 7,578,123 | B2 * | 8/2009 | Ohmura | 60/297 |
| 8,261,539 | B2 * | 9/2012 | Abraham et al. | 60/295 |
| 8,474,247 | B2 * | 7/2013 | Gomez, III | 60/295 |
| 8,584,446 | B2 * | 11/2013 | Arrigoni et al. | 60/295 |
| 8,915,067 | B2 * | 12/2014 | Oohashi et al. | 60/295 |
| 8,919,105 | B2 * | 12/2014 | Takayanagi et al. | 60/295 |
| 2008/0295491 | A1 | 12/2008 | Kuboshima et al. | |
| 2010/0089032 | A1 | 4/2010 | Iwashita et al. | |

FOREIGN PATENT DOCUMENTS

| | | |
|---|---|---|
| CN | 101627189 | 1/2010 |
| JP | 2000-145430 | 5/2000 |
| JP | 2003-027922 | 1/2003 |
| JP | 2005-264613 | 9/2005 |

(Continued)

*Primary Examiner* — Binh Q Tran

(74) *Attorney, Agent, or Firm* — Jordan and Hamburg LLP

(57) ABSTRACT

Provided is an engine device which improves a general-purpose property of an ECU carrying out a drive control of an engine and a regeneration control of a DPF. The engine device is provided with an exhaust gas purifying device which is arranged in an exhaust route of the engine, the ECU which controls a drive of the engine, and a variable memory means which stores a general-purpose regeneration program selectively executing a plurality of regeneration modes with respect to the exhaust gas purifying device and a flag table corresponding to an optional regeneration mode, and is rewritable. The ECU executes the general-purpose regeneration program in accordance with a regeneration mode which is selected on the basis of the flag table.

9 Claims, 11 Drawing Sheets

(56) References Cited

FOREIGN PATENT DOCUMENTS

| | | |
|---|---|---|
| JP | 2006-316731 | 11/2006 |
| JP | 2008-297969 | 12/2008 |
| JP | 2009-257220 | 11/2009 |
| JP | 2009-257264 | 11/2009 |
| JP | 2009-287456 | 12/2009 |
| JP | 2010-281311 | 12/2010 |

* cited by examiner

Fig 4

(a)

Flag table FT1 for self-regeneration

| Flag mark | Flag value |
|---|---|
| RGMOD | 0 |
| INTSLT | 0 |
| OUTSLT | 0 |
| APSTINJ | 1 |

(b)

Flag table FT2 for automatic auxiliary regeneration

| Flag mark | Flag value |
|---|---|
| RGMOD | 1 |
| INTSLT | 1 |
| OUTSLT | 1 |
| APSTINJ | 1 |

(c)

Flag table FT3 for manual auxiliary regeneration

| Flag mark | Flag value |
|---|---|
| RGMOD | 2 |
| INTSLT | 1 |
| OUTSLT | 1 |
| APSTINJ | 1 |

| Remarks |
|---|
| 0: Self-regeneration mode<br>1: Automatic auxiliary regeneration mode<br>2: Manual auxiliary regeneration mode |
| 0: Without intake throttle<br>1: With intake throttle |
| 0: Without exhaust throttle<br>1: With exhaust throttle |
| 0: Without auxiliary regeneration post injection<br>1: With auxiliary regeneration post injection |

ENGINE DEVICE

BACKGORUND OF THE INVENTION

The present invention relates to an engine device which is mounted on a working machine, for example, an engine power generator, a farm working machine, and a construction machine.

In recent years, in conjunction with an application of a high level exhaust gas regulation with regard to a diesel engine (hereinafter, refer simply to as an engine), it is going to be desired to mount an exhaust gas purifying device which purifies an air contaminant in the exhaust gas onto an engine power generator, a farm working machine, a construction machine or the like on which the engine is mounted. As the exhaust gas purifying device, a diesel particulate filter (hereinafter, refer to as DPF) has been known (refer to Patent Documents 1 and 2). The DPF is provided for collecting a particulate matter (hereinafter, refer to as PM) in the exhaust gas. In this case, if the PM collected by the DPF goes beyond a prescribed amount, a distribution resistance within the DPF is increased so as to cause a reduction of an engine output. Accordingly, it is frequently carried out to remove the PM which is piled up in the DPF by a temperature rise of the exhaust gas and recover a PM collecting capacity of the DPF (regenerate the DPF).

CITATION LIST

Patent Document 1: Japanese Unexamined Patent Publication No. 2000-145430

Patent Document 2: Japanese Unexamined Patent Publication No. 2003-27922

SUMMARY OF THE INVENTION

In this case, the engine is mounted on various working machines, for example, the engine power generator, the compressor, the farm working machine and the construction machine. Accordingly, in the engine with the DPF, a specification required for regenerating the DPF (a necessary engine auxiliary machine or the like) is various in correspondence to a kind of the working machine which is a subject to be mounted, and a control program for regenerating the DPF which is executed by an ECU is necessary in correspondence to the working machine. Accordingly, even if the type of the engine and the specification as a hardware of the ECU are the same, the control program stored in the ECU is different in correspondence to the working machine. Accordingly, there has been such a problem that a general purpose property of the ECU is low. Further, it is necessary for a manufacturer not only to control the various ECU in correspondence to the working machines at a time of manufacturing the engine, but also store the ECU in correspondence to the working machine as a parts inventory for a breakaway correspondence and a maintenance, after shipping the engine. Therefore, a control and store cost increases.

Accordingly, a technical object of the present invention is to provide an engine device to which an improvement is applied after making a study of the actual condition mentioned above.

In accordance with a first aspect of the present invention, there is provided an engine device including:

an exhaust gas purifying device which is arranged in an exhaust route of an engine; and an ECU which controls a drive of the engine, wherein the engine device is provided with a variable memory means which stores a general-purpose regeneration program selectively executing any of a plurality of regeneration modes with respect to the exhaust gas purifying device, and a flag table corresponding to an optional regeneration mode, and is rewritable, and the ECU executes the general-purpose regeneration program in accordance with the regeneration mode which is selected on the basis of the flag table.

In accordance with a second aspect of the present invention, in the engine device described in the first aspect, a fixed memory means which fixedly stores the flag table is provided, and the flag table stored in the fixed memory means is written in the variable memory means at a first accessing time of the fixed memory means and the variable memory means.

In accordance with a third aspect of the present invention, in the engine device described in the first aspect, a plurality of regeneration modes are provided with at least a self regeneration mode which drives the engine under a condition that the exhaust gas purifying device is regenerable, an automatic auxiliary regeneration mode which automatically raises a temperature of the exhaust gas in the case that a clogged degree of the exhaust gas purifying device goes beyond a prescribed level, and a manual auxiliary regeneration mode which allows the regeneration of the exhaust gas purifying device on the basis of a turn-on operation of a manual operating means.

In accordance with a fourth aspect of the present invention, in the engine device described in any one of the first to third aspects, necessity of a trouble diagnosis of an engine auxiliary machine which is relevant to the regeneration of the exhaust gas purifying device is determined in correspondence to the flag table, at a time of executing the general-purpose regeneration program.

In accordance with the first aspect of the present invention, in the engine device including: the exhaust gas purifying device which is arranged in the exhaust route of the engine, and the ECU which controls the drive of the engine, the engine device is provided with the variable memory means which stores the general-purpose regeneration program selectively executing any of a plurality of regeneration modes with respect to the exhaust gas purifying device, and the flag table corresponding to the optional regeneration mode, and is rewritable, and the ECU executes the general-purpose regeneration program in accordance with the regeneration mode which is selected on the basis of the flag table. Accordingly, it is possible to correspond to the different regeneration modes per kind of the working machines, only by changing the flag table in one kind of the general-purpose regeneration program. In accordance with this, it is possible to achieve such an effect that a common use (a common specification) of the ECU can be achieved with respect to the various working machines. In other words, it is possible to achieve an effect that an advantage of an improvement of the general purpose property of the ECU and an advantage of ensuring adequacy with respect to each of the regeneration modes of the ECU are compatible.

Further, it is not necessary to develop the program for regenerating the exhaust gas purifying device per kind of the various working machine, and there is an advantage that it contributes to a cost suppression. Further, since the general-purpose regeneration program can be easily switched to one which corresponds to the kind of the working machine only by changing the flag table without any special knowledge of a programming, it becomes easy to provide an engine device which meets a customer's (an engine buying manufacture's) demand.

In accordance with the second aspect of the present invention, in the engine device described in the first aspect, the fixed memory means which fixedly stores the flag table is provided, and the flag table stored in the fixed memory means is written in the variable memory means at the first accessing time of the fixed memory means and the variable memory means. Accordingly, it is possible to easily execute the DPF regeneration control in accordance with a different regeneration mode from an initial setting, by rewriting the flag table which is stored in the variable memory means later. Therefore, in the case that it is intended to change the regeneration mode, it is not necessary to delete the flag table each time, for example, by changing the fixed memory means, or to rewrite the general-purpose regeneration program, and there is obtained such an effect that it is easy to cope with the systems of the various working machines. For example, for the customer, it is easy to modify a setting to a setting which is suitable for its own specification in spite of the engine which is bought externally.

In accordance with the third aspect of the present invention, in the engine device described in the first or second aspect, a plurality of regeneration modes are provided with at least the self regeneration mode which drives the engine under the condition that the exhaust gas purifying device is regenerable, the automatic auxiliary regeneration mode which automatically raises the temperature of the exhaust gas in the case that the clogged degree of the exhaust gas purifying device goes beyond the prescribed level, and the manual auxiliary regeneration mode which allows the regeneration of the exhaust gas purifying device on the basis of the turn-on operation of the manual operating means. Accordingly, it is possible to cope with a plurality of regeneration modes which are suitable for the various types of working machines, by the system of the one kind of engine device. Therefore, there can be obtained such an effect that it is possible to further improve a customer satisfaction.

In accordance with the fourth aspect of the present invention, in the engine device described in any one of the first to third aspects, necessity of the trouble diagnosis of the engine auxiliary machine which is relevant to the regeneration of the exhaust gas purifying device is determined in correspondence to the flag table, at a time of executing the general-purpose regeneration program. Accordingly, even if the engine auxiliary machine is provided or not on the basis of the difference of the regeneration mode, it is possible to execute the trouble diagnosis of the engine auxiliary machine if necessary, only by one kind of the general-purpose regeneration program, and it is possible to omit the trouble diagnosis of the engine auxiliary machine if not necessary. In other words, there can be obtained such an effect that the execution and the omit of the trouble diagnosis can be easily switched in correspondence to whether or not the engine auxiliary machine is provided, without any detail-oriented setting and operation.

BRIEF DESCRIPTION OF THE DRAWINGS

FIGS. 4A to 4C are explanatory views of a flag table corresponding to each of regeneration modes, in which FIG. 4A is a view of a flag table for a self regeneration, FIG. 4B is a view of a flag table for an automatic auxiliary regeneration, and FIG. 4C is a view of a flag table for a manual auxiliary regeneration;

DESCRIPTION OF THE PREFERRED EMBODIMENTS

Figure 1:
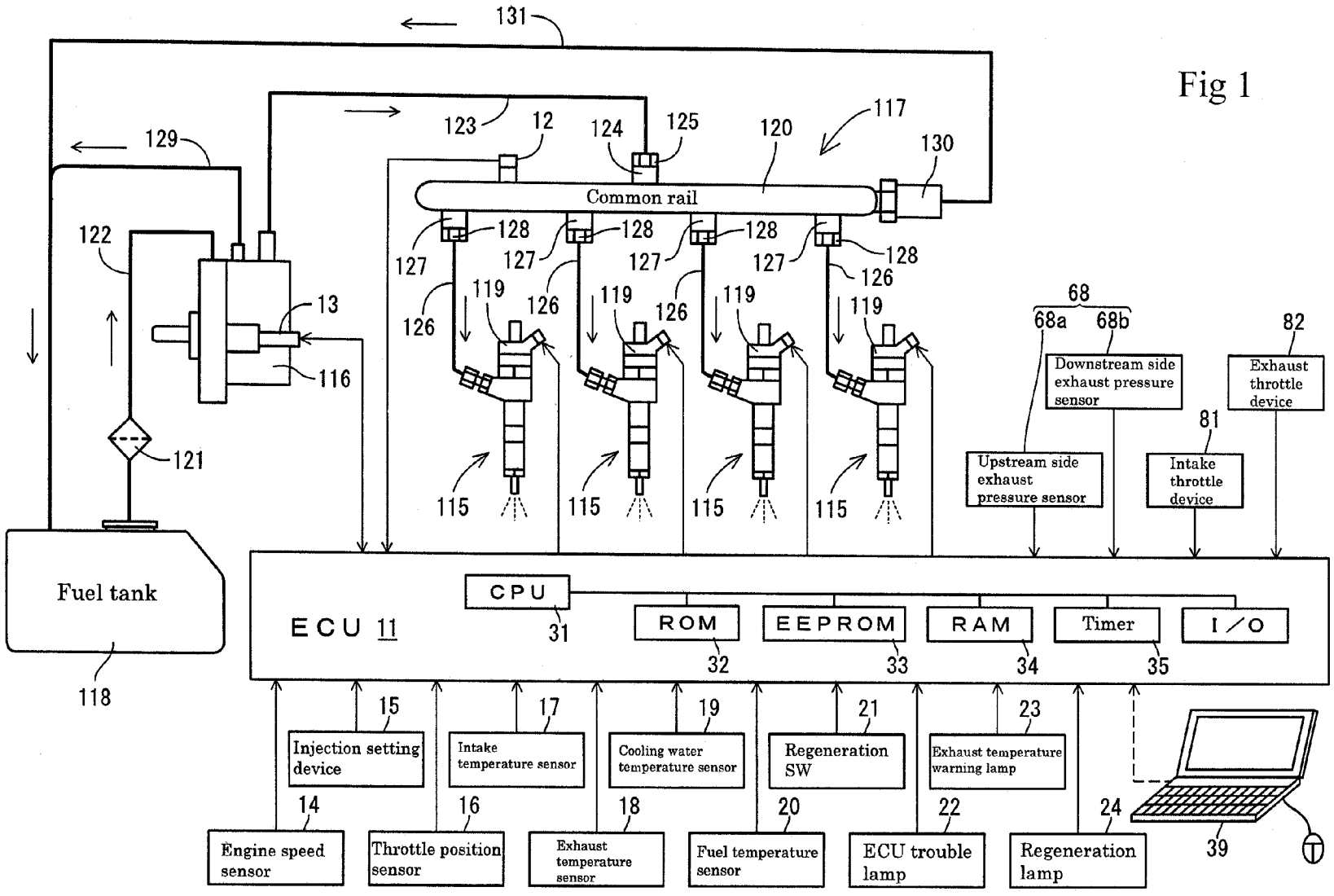
FIG. 1 is an explanatory view of a fuel system of an engine.

A description will be given below of an embodiment which embodies the present invention on the basis of the accompanying drawings.

(1) Engine and Peripheral Structure Thereof

First of all, a description will be given of an engine and a peripheral structure thereof with reference to FIG. 1 and FIG. 2. As shown in FIG. 2, an engine 70 is a four-cylinder type diesel engine, and is provided with a cylinder block 75 in which a cylinder head 72 is fastened to its top face. An intake manifold 73 is connected to one side face of the cylinder head 72, and an exhaust manifold 71 is connected to the other side face. A common rail system 117 which supplies a fuel to each of cylinders of the engine 70 is provided blow the intake manifold 73 on a side face of the cylinder block 75. An intake throttle device 81 for adjusting an intake pressure (an intake amount) of the engine 70 and an air cleaner (an illustration of which is omitted) are connected to an intake pipe 76 which is connected to an intake upstream side of the intake manifold 73.

Figure 2:
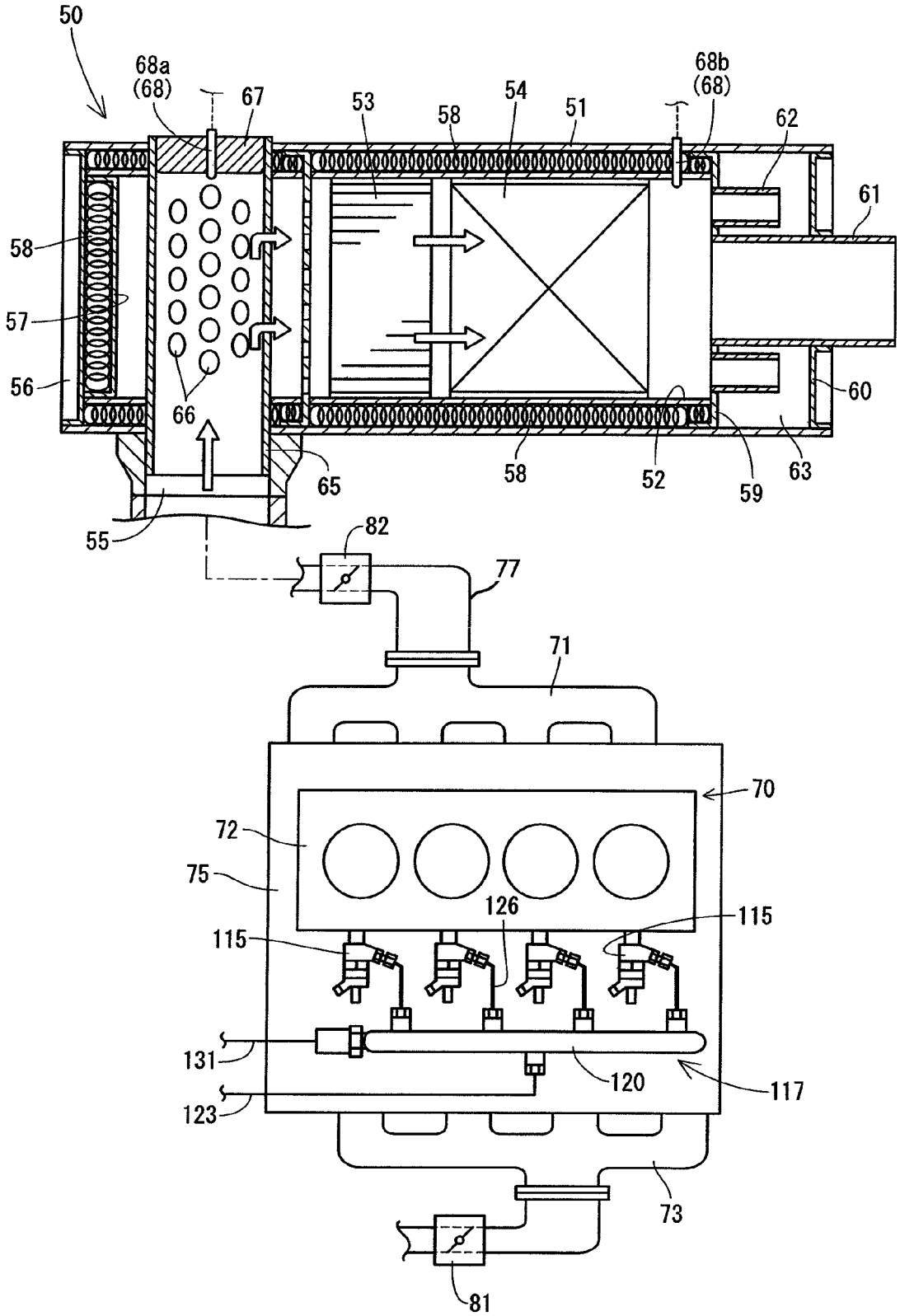
FIG. 2 is a function block diagram showing a relationship between the engine and an exhaust gas purifying device.

As shown in FIG. 1, a fuel tank 118 is connected to each of injectors 115 for four cylinders in the engine 70 via the common rail system 117 and a fuel supply pump 116. Each of the injectors 115 is provided with an electromagnetic opening and closing control type fuel injection valve 119. The common rail system 117 is provided with a cylindrical common rail 120. The fuel tank 118 is connected to an intake side of the fuel supply pump 116 via a fuel filter 121 and a low pressure pipe 122. The fuel within the fuel tank 118 is sucked into the fuel supply pump 116 via the fuel filter 121 and the low pressure pipe 122. The fuel supply pump 116 in accordance with the embodiment is arranged in the vicinity of the intake manifold 73. On the other hand, a common rail 120 is connected to a discharge side of the fuel supply pump 116 via a high pressure pipe 123. The injectors 115 for four cylinders are connected to the common rail 120 via four fuel injection pipes 126.

In the structure mentioned above, the fuel in the fuel tank 118 is pressure fed to the common rail 120 by the fuel supply pump 116, and the fuel having a high pressure is stored in the common rail 120. Since each of the fuel injection valves 119 is controlled so as to be opened and closed, the fuel having the high pressure within the common rail 120 is injected from each of the injectors 115 to each of the cylinders of the engine 70. In other words, an injection pressure, an injecting timing, and an injection period (an injection amount) of the fuel which is supplied from each of the injectors 115 are controlled at a high precision, by electronically controlling each of the fuel injection valves 119. Accordingly, it is possible to reduce a nitrogen oxide (NOx) from the engine 70, and to reduce a noise vibration of the engine 70.

In this case, as shown in FIG. 1, a fuel supply pump 116 is connected to the fuel tank 118 via a fuel return pipe 129. A common rail return pipe 131 is connected to an end portion in a longitudinal direction of the cylindrical common rail 120 via a return pipe connector 130 which limits a pressure of the fuel within the common rail 120. In other words, a surplus fuel of the fuel supply pump 116 and a surplus fuel of the common rail 120 are recovered in the fuel tank 118 via the fuel return pipe 129 and the common rail return pipe 131.

To an exhaust pipe 77 which is connected to an exhaust downstream side of the exhaust manifold 71, there are connected an exhaust throttle device 82 for adjusting an exhaust pressure of the engine 70, and a diesel particulate filter 50 (hereinafter, refer to as DPF) which is one example of an exhaust gas purifying device. The exhaust gas which is discharged from each of the cylinders to the exhaust manifold 71 is purified through the exhaust pipe 77, the exhaust throttle device 82, and the DPF 50, and is thereafter discharged to an external portion.

The DPF 50 is provided for collecting a particulate matter (hereinafter, refer to as PM) in the exhaust gas. The DPF 50 in accordance with the embodiment is structured such that a diesel oxidizing catalyst 53, for example, a platinum or the like, and a soot filter 54 are lined up in series so as to be accommodated in an approximately tubular filter case 52 which is within a casing made of a heat resisting metal material. In the embodiment, the diesel oxidizing catalyst 53 is arranged in an exhaust upstream side within the filter case 52, and the soot filter 54 is arranged in an exhaust downstream side. The soot filter is formed as a honeycomb structure having a lot of cells which are zoned by a porous (filterable) partition wall.

One side portion of the casing 51 is provided with an exhaust introduction port 55 which is communicated with the exhaust downstream side of the exhaust throttle device 82 in the exhaust pipe 77. One end portion of the casing 51 is clogged by a first bottom plate 56, and one end portion facing to the first bottom plate 56 in the filter case 52 is clogged by a second bottom plate 57. A heat insulating material 58 such as a glass wool is filled in an annular gap between the casing 51 and the filter case 52, and a gap between both the bottom plates 56 and 57 in such a manner as to surround a periphery of the diesel oxidizing catalyst 53 and the soot filter 54. The other end portion of the casing 51 is clogged by two lid plates 59 and 60, and an approximately tubular exhaust discharge port 61 passes through both the lid plates 59 and 60. Further, a portion between both the lid plates 59 and 60 comes to a resonance chamber 63 which is communicated within the filter case 52 via a plurality of communication pipes 62.

An exhaust gas introduction pipe 65 is inserted to an exhaust introduction port 55 which is formed in one side portion of the casing 51. A leading end of the exhaust gas introduction pipe 65 cuts across the casing 51 and protrudes to a side face opposite to the exhaust introduction port 55. A plurality of communication holes 66 which are open toward the filter case 52 are formed in an outer peripheral surface of the exhaust gas introduction pipe 65. A portion protruding to the side face opposite to the exhaust introduction port 55 in the exhaust gas introduction pipe 65 is clogged by a lid body 67 which is detachably attached by screw thereto.

The DPF 50 is provided with a differential pressure sensor 68 which detects a clogged state of the soot filter 54 as one example of the detecting means. The differential pressure sensor 68 in accordance with the embodiment is structured such as to detect a pressure difference (a differential pressure) between upstream and downstream sides with respect to the soot filter 54 within the DPF 50. In this case, an upstream side exhaust pressure sensor 68*a* which constructs the differential pressure sensor 68 is installed to the lid body 67 of the exhaust gas introduction pipe 65, and a downstream side exhaust pressure sensor 68*b* is installed between the soot filter 54 and the resonance chamber 63. It has been well known that a fixed rule exists between the pressure difference between the upstream and downstream sides of the DPF 50 and a PM stacking amount within the DPF 50. In the embodiment, a regeneration control (a DPF regeneration control) of the soot filter 54 is executed by estimating the PM stacking amount within the DPF 50 from the pressure difference which is detected by the differential pressure sensor 68, and actuating the intake throttle device 81, the exhaust throttle device 82, and the common rail 120 on the basis of a result of estimation.

In this case, a structure detecting the clogged state of the soot filter 54 is not limited to the differential pressure sensor 68, but may be an exhaust pressure sensor which detects the pressure in the upstream side of the soot filter 54 within the DPF 50. In the case that the exhaust pressure sensor is employed, the clogged state of the soot filter 54 is determined by comparing a pressure (a reference pressure) in the upstream side of the soot filter 54 at a brand-new state in which the PM is not stacked in the soot filter 54, with the current pressure which is detected by the exhaust pressure sensor.

In the structure mentioned above, the exhaust gas from the engine 5 enters into the exhaust gas introduction pipe 65 via the exhaust introduction port 55, jets out into the filter case 52 from each of the communication holes 66 which are formed in the exhaust gas introduction pipe 65, is dispersed into a wide region within the filter case 52, and thereafter passes through the diesel oxidizing catalyst 53 and the soot filter 54 in this order so as to be purified. The PM in the exhaust gas can not pass through the porous partition wall between the cells in the soot filter 54 so as to be collected in this stage. Thereafter, the exhaust gas which passes through the diesel oxidizing catalyst 53 and the soot filter 54 is discharged out of the exhaust discharge port 61.

If an exhaust gas temperature goes beyond a regenerable temperature (for example, about 300° C.) at a time when the exhaust gas passes through the diesel oxidizing catalyst 53 and the soot filter 54, NO (nitrogen monoxide) in the exhaust gas is oxidized into an unstable $NO_2$ (nitrogen dioxide) due to an action of the diesel oxidizing catalyst 53. Further, the PM collecting capacity of the soot filter 54 is recovered (the soot filter 54 (the DPF 50) is regenerated) by oxidizing and removing the PM which is stacked in the soot filter 54, by O (oxygen) which is discharged at a time when $NO_2$ is returned to NO.

(2) Structure Relevant to Control of Engine

Next, a description will be given of a structure which is relevant to the control of the engine 70 with reference to FIG. 1 to FIG. 5. As shown in FIG. 1, there is provided an ECU 11 which actuates the fuel injection valve 119 of each of the cylinders in the engine 70. The ECU 11 is provided with a ROM 32 serving as a fixed memory means which previously stores various data in a fixed manner, an EEPROM 33 serving as a variable memory means which stores a general-purpose regeneration program GPM or the like selectively executing any of a plurality of regeneration modes mentioned below and is rewritable, a RAM 34 which temporarily stores various data, a timer 35 for measuring a time, an input and output interface and the like, in addition to a CPU 31 which executes various computing processes and controls, and the ECU 11 is arranged in the engine 70 or in the vicinity thereof.

To an input side of the ECU 11, there are connected a rail pressure sensor 12 which detects at least a fuel pressure within the common rail 120, an electromagnetic clutch 13 which rotates or stops the fuel pump 116, an engine speed sensor 14 which detects a rotating speed of the engine 70 (a cam shaft position of the crank shaft 74), an injection setting device 15 which detects and sets a number of fuel injection of the injector 115 (a number during a fuel injection period of one stroke), a throttle position sensor 16 which detects an operating position of an accelerator operating device (an illustration of which is omitted) such as a throttle lever or an accelerator pedal, an intake temperature sensor 17 which detects an intake temperature in an intake route, an exhaust temperature sensor 18 which detects an exhaust gas temperature in an exhaust route, a cooling water temperature sensor 19 which detects a cooling water temperature of the engine 70, a fuel temperature sensor 20 which detects a fuel temperature within the common rail 120, a regeneration switch 21 serving as a manual operating means which selectively operates whether or not a manual auxiliary regeneration mode mentioned below is executed, and the differential pressure sensor 68 (the upstream side exhaust pressure sensor 68*a* and the downstream side exhaust pressure sensor 68*b*).

At least an electromagnetic solenoid of each of the fuel injection valves 119 for four cylinders is connected to the output side of the ECU 11. In other words, since the high pressure fuel which is stored in the common rail 120 is injected from the fuel injection valve 119 at plural times during one stroke, while controlling the fuel injection pressure, the injection timing, and the injection period, a generation of the nitrogen oxide (NOx) is suppressed, and a complete combustion in which a generation of a carbon dioxide or the like is reduced is executed, thereby improving a fuel consumption.

Figure 5:
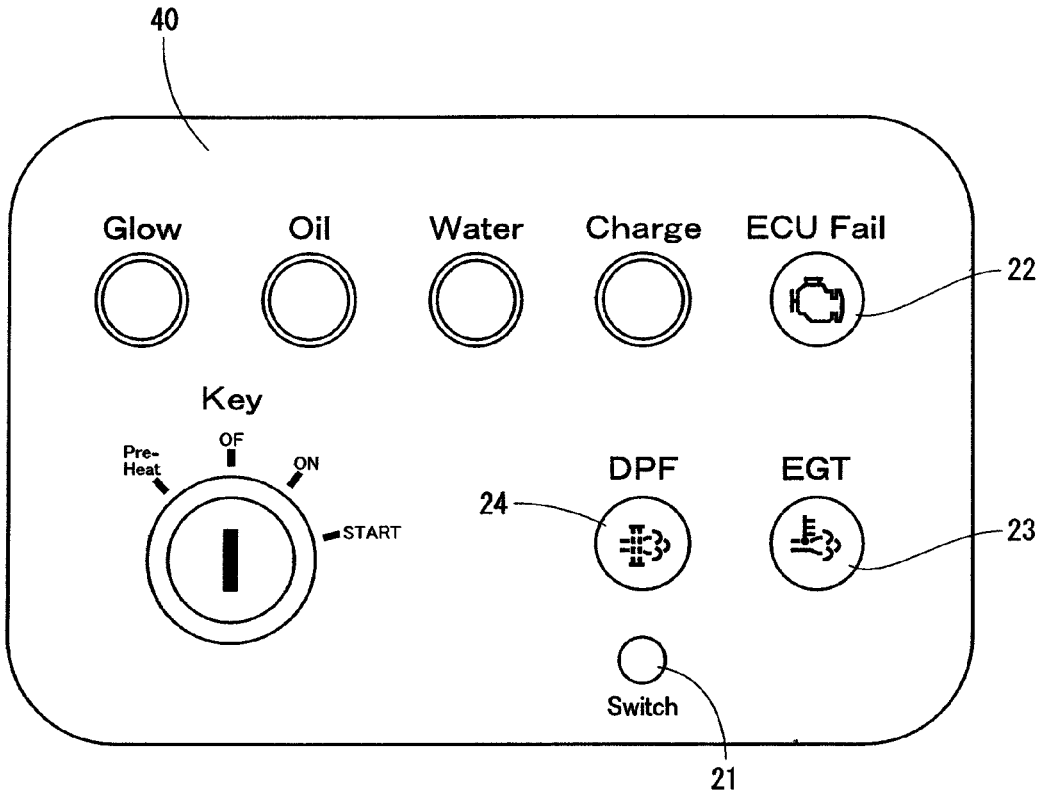
FIG. 5 is an explanatory view of a display panel.

Further, to an output side of the ECU 11, there are connected the intake throttle device 81 for adjusting the intake pressure (the intake amount) of the engine 70, the exhaust throttle device 82 for adjusting the exhaust pressure of the engine 70, an ECU trouble lamp 22 which gives a warning and informs of the trouble of the ECU 11, an exhaust temperature warning lamp 23 which informs of an abnormally high temperature of the exhaust gas temperature, and a regeneration lamp 24 which is turned on in accordance with the execution of each of the regeneration modes mentioned below. The data relating to a blinking of each of the lamps 22 to 24 is previously stored in the EEPROM 33 of the ECU 11. In this case, as shown in FIG. 5, the regeneration switch 21 and each of the lamps 22 to 24 are provided in an instrument panel 40 which is provided in a working machine to which the engine is mounted.

In the EEPROM 33 of the ECU 11, there is previously stored an output characteristic map M (refer to FIG. 3) which indicates a relationship between a rotating speed N and a torque T (a load) of the engine 70. In the EEPROM 33, there are also previously stored a main program MPM (refer to FIG. 6) about the regeneration control of the DPF 50, and a general-purpose regeneration program GPM (refer to FIG. 7) which selectively executes any of a plurality of regeneration modes. Flows of the programs MPM and GPM will be mentioned later.

Figure 3:
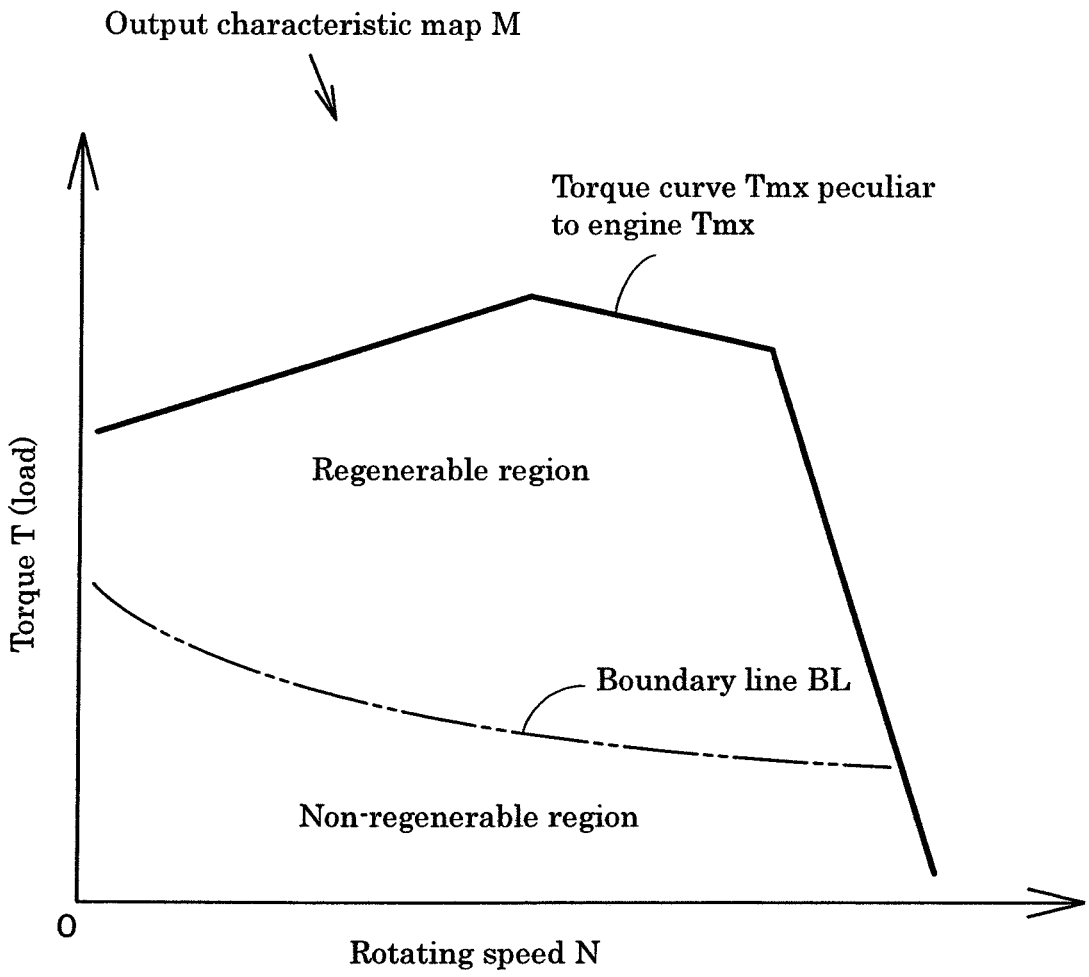
FIG. 3 is an explanatory view of an output characteristic map.

The output characteristic map M is determined on the basis of an experiment or the like. In the characteristic map M shown in FIG. 3, the rotating speed N is set to a horizontal axis and the torque T is set to a vertical axis. The output characteristic map M is a region which is surrounded by a solid line Tmx drawn convex upward. The solid line Tmx is a maximum torque line which shows a maximum torque with respect to each of the rotating speeds N. In this case, if the type of the engine 70 is the same, the output characteristic maps M stored in the ECU 11 are all identical (common). As shown in FIG. 3, the output characteristic map M is segmentalized into upper and lower sections by a boundary line BL which shows a relationship between the rotating speed N and the torque T in the case that the exhaust gas temperature is a regeneration boundary temperature (about 300° C.). The upper region with respect to the boundary line BL is a regenerable region which can oxidize and remove the PM stacked in the soot filter 54 (on which an oxidizing action of the oxidizing catalyst 53 acts), and the region in the lower side is a regeneration incapable region in which the PM is stacked in the soot filter 54 without being oxidized and removed.

The ECU 11 is basically structured such as to execute a fuel injection control of determining the torque T from the rotating speed N which is detected by the engine speed sensor 14 and the throttle position which is detected by the throttle position sensor 16, computing a target fuel injection amount by using the torque T and the output characteristic map M, and actuating the common rail system 117 on the basis of the result of computation. In this case, the fuel injection amount is adjusted by adjusting a valve opening period of each of the fuel injection valves 119 and changing the injection period to each of the injectors 115.

In the ROM 32 of the ECU 11, there is previously stored a flag table FT which corresponds to each of the regeneration modes relating to the regeneration control of the DPF 50. As shown in FIGS. 4A to 4C, the flag table FT exists per kind of the regeneration modes, and serves as an identification factor of the regeneration mode. In the ROM 32 in accordance with the embodiment, one kind of flag table FT per kind of the regeneration mode, that is, corresponding to the working machine to which the engine is mounted is written before shipping the engine (at a time of manufacturing the engine) by using an external tool 39 such as a ROM writer or the like which is connected to the ECU 11 via a communication terminal line.

The regeneration mode which is executed in the engine device includes, at least a self regeneration mode which drives the engine 70 under a condition that the DPF 50 is regenerable, an automatic auxiliary regeneration mode which automatically raises a temperature of the exhaust gas in the case that a clogged degree of the DPF 50 goes beyond a prescribed level, and a manual auxiliary regeneration mode which allows the regeneration of the DPF 50 on the basis of a turn-on operation of the regeneration switch 21. The self regeneration mode is mainly used in a working machine such as an engine power generator or the like which drives the engine 70 at approximately fixed rotating speed N and torque T. The automatic auxiliary regeneration mode is mainly used in a general working machine such as a combine harvester, a tractor or the like. The manual auxiliary regeneration mode is mainly used in a working machine such as a hydraulic shovel or the like which executes an accurate work on the basis of an engine sound. In this case, "under regenerable condition" in the self regeneration mode means a state in which the relationship between the rotating speed N and the torque T in the engine 70 is in the regenerable region (the upper region with respect to the boundary line BL) of the output characteristic map M, and the exhaust gas temperature of the engine 70 is high such that the PM oxidizing amount within the DPF 50 goes beyond the PM collecting amount.

Accordingly, in the case that the subject to be mounted to the engine is, for example, the engine power generator, the flag table FT1 for the self regeneration (refer to FIG. 4A) corresponding to the self regeneration mode is stored in the ROM 32. In the case that the subject to be mounted to the engine is, for example, the combine harvester, the flag table FT2 for the automatic auxiliary regeneration (refer to FIG. 4B) corresponding to the automatic auxiliary regeneration mode is stored in the ROM 32. In the case that the subject to be mounted to the engine is, for example, the hydraulic shovel, the flag table FT3 for the manual auxiliary regeneration (refer to FIG. 4C) corresponding to the manual auxiliary regeneration mode is stored in the ROM 32. In this case, as described above, in the case that the flag table is expressed per kind, a relationship with the corresponding regeneration mode is indicated by attaching a numeral to reference symbol FT, and "FT" having no numeral is used at a time of expressing the flag table in a lump or expressing an optional flag table.

One kind of flag table FT which is stored in the ROM 32 is written (copied) in the EEPROM 33 side at a first accessing time of the ROM 32 and the ERPROM 33, that is, at a time when the working machine is first turned on and the ROM 32 and the EEPROM 33 are electrically connected. The writing process is carried out at a time when the ECU 11 executes the main program MPM (refer to FIG. 6). The ECU 11 selects the regeneration mode on the basis of the flag table FT which is written in the EEPROM 33 side, and executes the general-purpose regeneration program GPM in accordance with the selected regeneration mode (refer to FIG. 7).

(3) Aspect of Main Process

Figure 6:
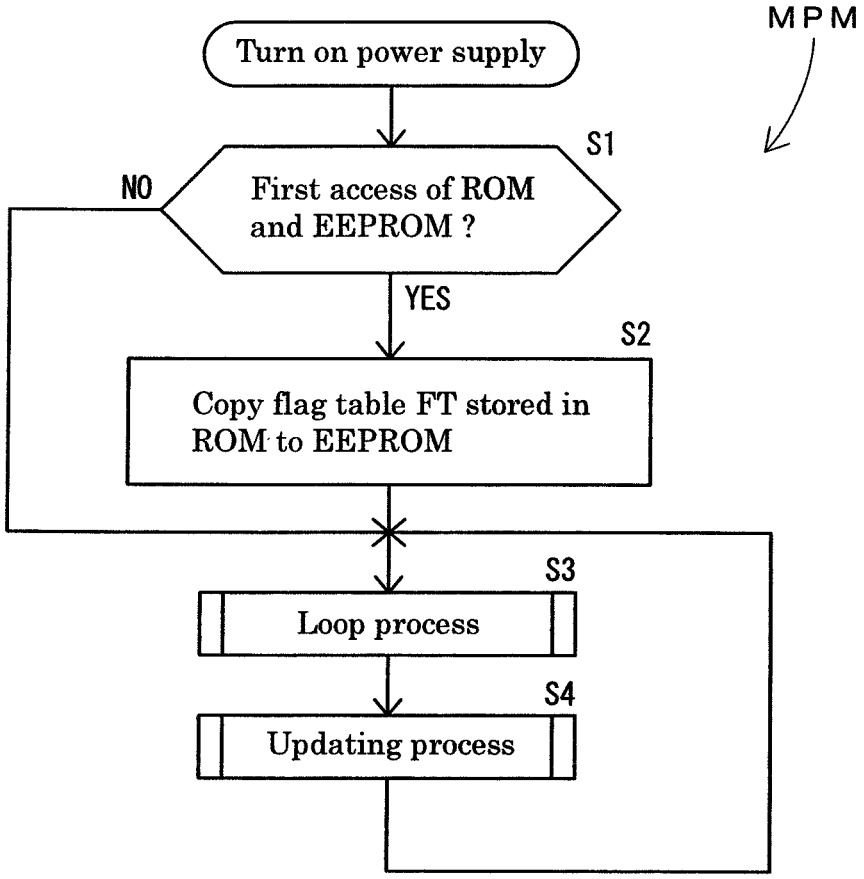
FIG. 6 is a flow chart showing a flow of a basic program about a DPF regeneration control.

Next, as description will be given of one example of the main process of the DPF regeneration control by the ECU 11 with reference to a flow chart in FIG. 6. An algorithm shown by the flow chart in FIG. 6 is stored as the main program MPM in the EEPROM 33, and is executed by the CPU 31 after being called by the RAM 34. In this case, the main program MPM activates by turning on the working machine, and if the access of the ROM 32 and the EEPROM 33 is first time (S1: YES), one kind of flag table FT stored in the ROM 32 is written in the EEPROM 33 side (S2). Next, the step calls the general-purpose regeneration program GPM, selects the regeneration mode on the basis of the flag table FT which is written in the EEPROM 33 side, and executes a loop process (a DPF regeneration control) on the basis of the general-purpose regeneration program GPM in accordance with the selected regeneration mode (S3). Thereafter, if the external tool 39 is connected to the ECU 11, the step executes an updating process of rewriting the data (the flag table FT, the general-purpose regeneration program GPM or the like) which is stored in the EEPROM 33, by using the external tool 39 (S4).

In accordance with the control mentioned above, since it is possible to easily execute the DPF regeneration control in accordance with the regeneration mode which is different from the initial setting by later rewriting the flag table FT which is stored in the EEPROM 33, it is not necessary to delete the flag table FT each time, for example, by changing the ROM 32 or rewrite the general-purpose regeneration program GPM, in the case that it is intended to change the regeneration mode. Therefore, it is possible to achieve such an effect of easily coping with the systems of the various working machines. For example, for the customer (the engine buying manufacturer), it is easy to modify a setting to one suitable for its own specification in spite of the engine 70 which is bought externally.

(4) First Embodiment of Loop Process

Next, a description will be given of a first embodiment of a loop process of the DPF regeneration control by the ECU 11 with reference to flow charts in FIG. 7, FIG. 8, and FIG. 11. The first embodiment shows a case that the engine 70 is mounted to the working machine of the type that executes the self-regeneration mode (for example, the engine power generator). In this kind of working machine, since the engine 70 is driven by the approximately fixed rotating speed N and torque T, the temperature of the exhaust gas of the engine 70 comes to such a high temperature that the PM oxidizing amount within the DPF 50 goes beyond the PM collecting amount. Taking the point into consideration, in the engine device in accordance with the first embodiment, the intake throttle device 81, the exhaust throttle device 82, and the regeneration switch 21 are omitted.

Figure 7:
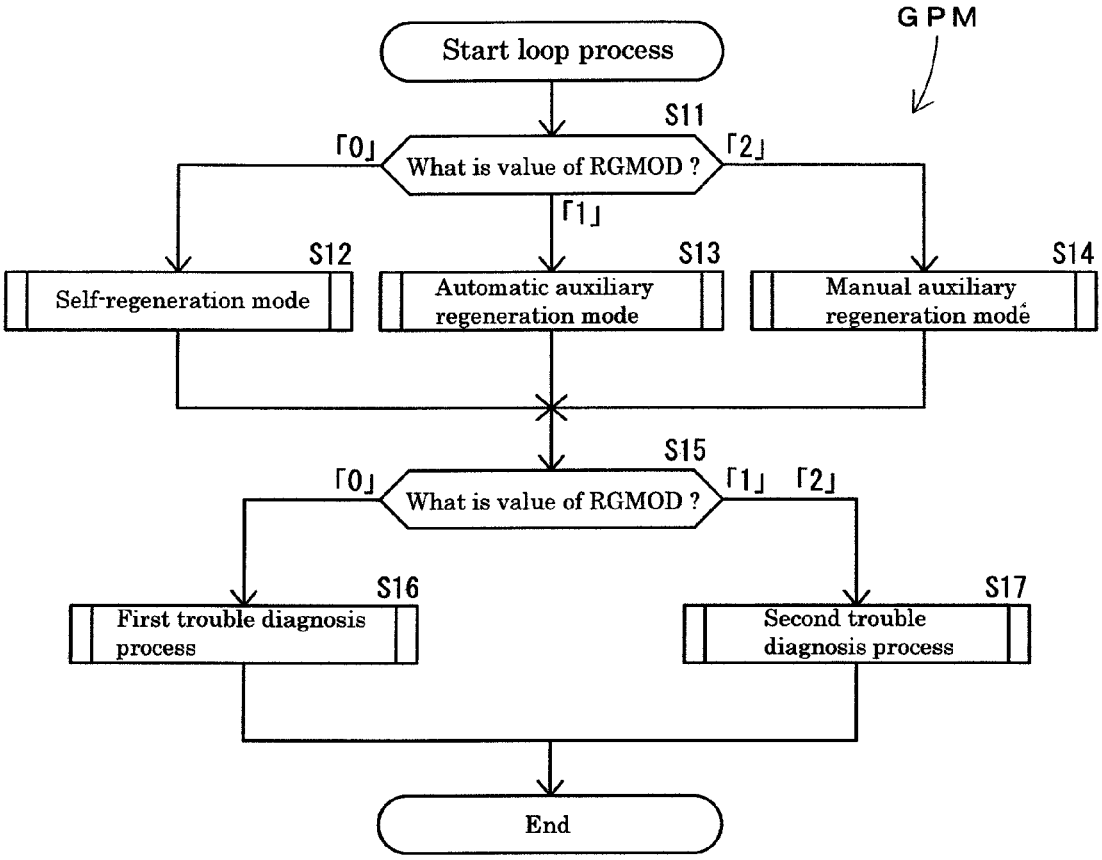
FIG. 7 is a flow chart showing a flow of a general-purpose regeneration program.
Figure 8:
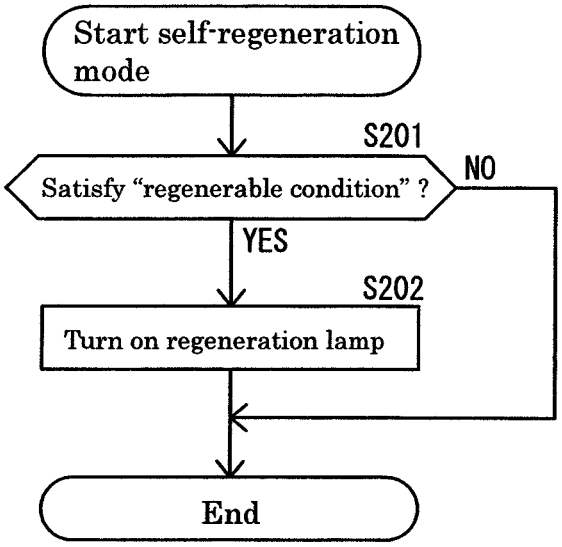
FIG. 8 is a flow chart of the self regeneration mode.
Figure 10:
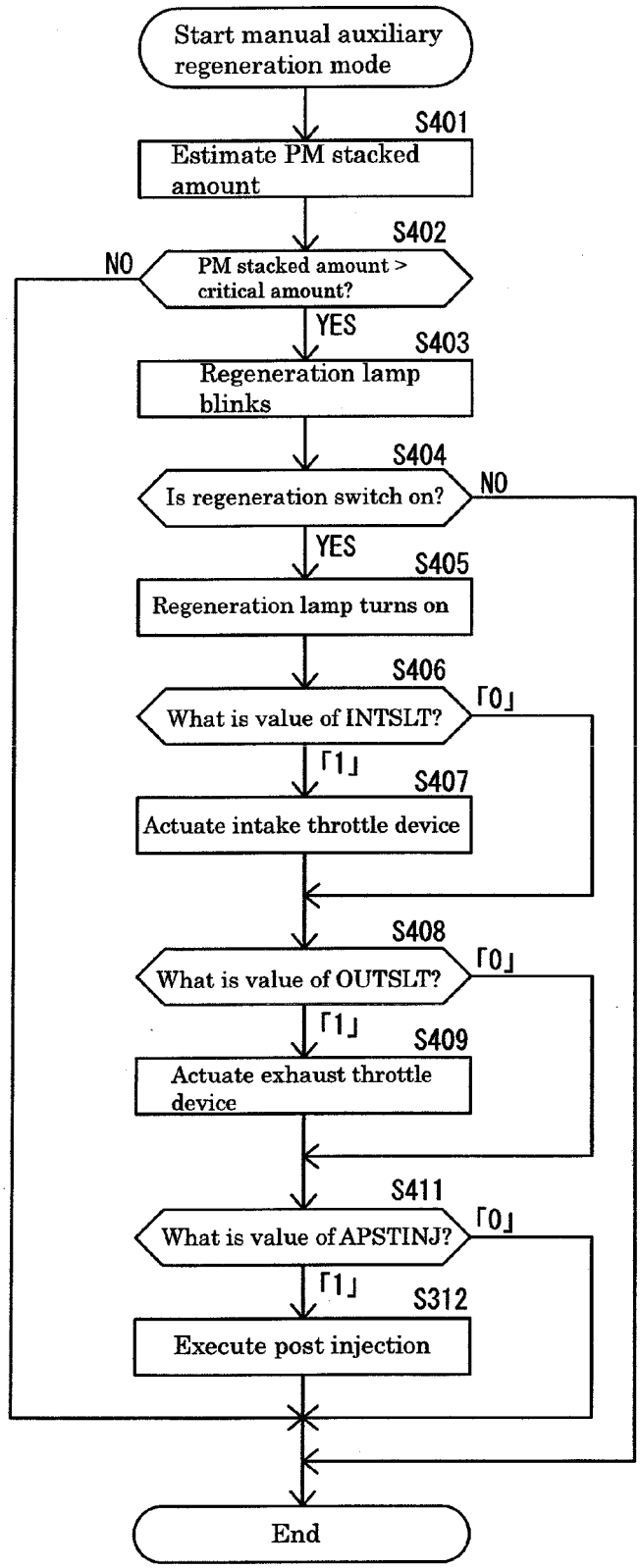
FIG. 10 is a flow chart of the manual auxiliary regeneration mode.
Figure 11:
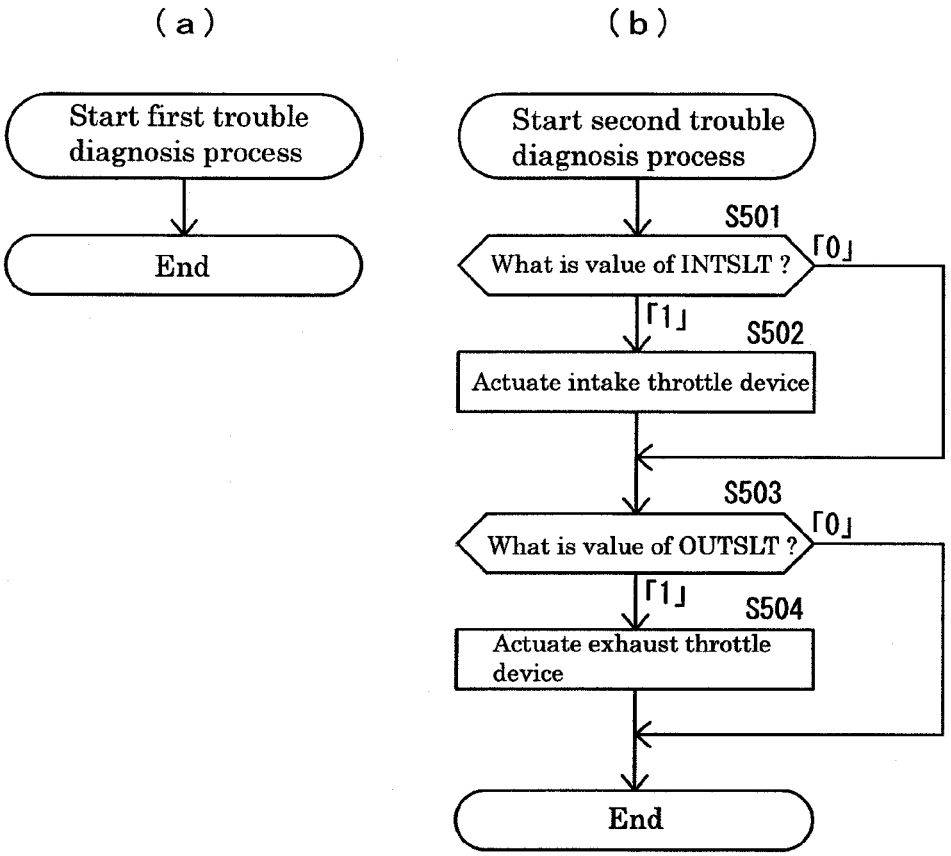
FIGS. 11A and 11B are flow charts of a trouble diagnosis process, in which FIG. 11A corresponds to the self regeneration mode, and FIG. 11B corresponds to the automatic and manual auxiliary regeneration modes.

An algorithm shown by the flow charts in FIG. 7, FIG. 8, and FIG. 11 is stored as the general-purpose regeneration program GPM in the EEPROM 33. A flow chart of a self-regeneration mode in FIG. 8, and a flow chart of a trouble diagnosis process in FIGS. 11A and 11B are both subroutines of the general-purpose regeneration program GPM. The general-purpose regeneration program GPM is read from the EEPROM 33 to the RAM 34 so as to be executed by the CPU 31. In this case, though the general-purpose regeneration program GPM is varied in its subroutines (refer to FIG. 8 to FIG. 11) in accordance with the difference of the regeneration mode, a common one is used in second and third embodiments mentioned later.

In the loop process of the first embodiment, first of all, the step discriminates a value of a mode selection flag RGMOD during the flag table FT1 for the self-regeneration which is read from the EEPROM 33 (S11). In the first embodiment, since the value of the mode selection flag RGMOD is "0", the step calls the subroutine of the self-regeneration mode shown in FIG. 8 and executes the self-regeneration process (S12). In the subroutine of the self-regeneration mode, the step discriminates whether or not the DPF 50 is "under regenerable condition" (S201), turns of the regeneration lamp 24 on the instrument panel 40 (S202) if it is "under regenerable condition" (S201: YES), and informs an operator of the fact that the self-regeneration of the DPF 50 does well. Thereafter, the step returns to the main routine of the loop process, and again discriminates the value of the mode selection flag RGMOD (S15). In this case, since RGMOD="0" is established, the step calls the subroutine shown in FIG. 11A and executes the first trouble diagnosis process (S16). As mentioned above, since the engine auxiliary machine utilized for regenerating the DPF 50, that is, the intake and exhaust throttle devices 81 and 82, is omitted in the working machine of the type which executes the self-regeneration mode, an equipment which is subjective to trouble diagnosis does not exist. Accordingly, as shown in the flow chart in FIG. 11A, the step finishes by doing nothing in the first trouble diagnosis process, and returns to the main routine of the loop process to be finished.

(5) Second Embodiment of Loop Process

Next, a description will be given of a second embodiment of the loop process of the DPF regeneration control by the ECU 11 with reference to a flow chart in FIG. 9. The second embodiment shows a case that the engine 70 is mounted to the working machine of the type that executes the automatic auxiliary regeneration mode (for example, the combine harvester or the like). In the automatic auxiliary regeneration mode, since the temperature of the exhaust gas is raised automatically in the case that the clogged degree of the DPF 50 goes beyond the prescribed level, the intake and exhaust throttle devices 81 and 82 are provided, in the engine device in accordance with the second embodiment. However the regeneration switch 21 which selects whether or not the regeneration mode is executed in accordance with an intension of the operator is omitted.

Figure 9:
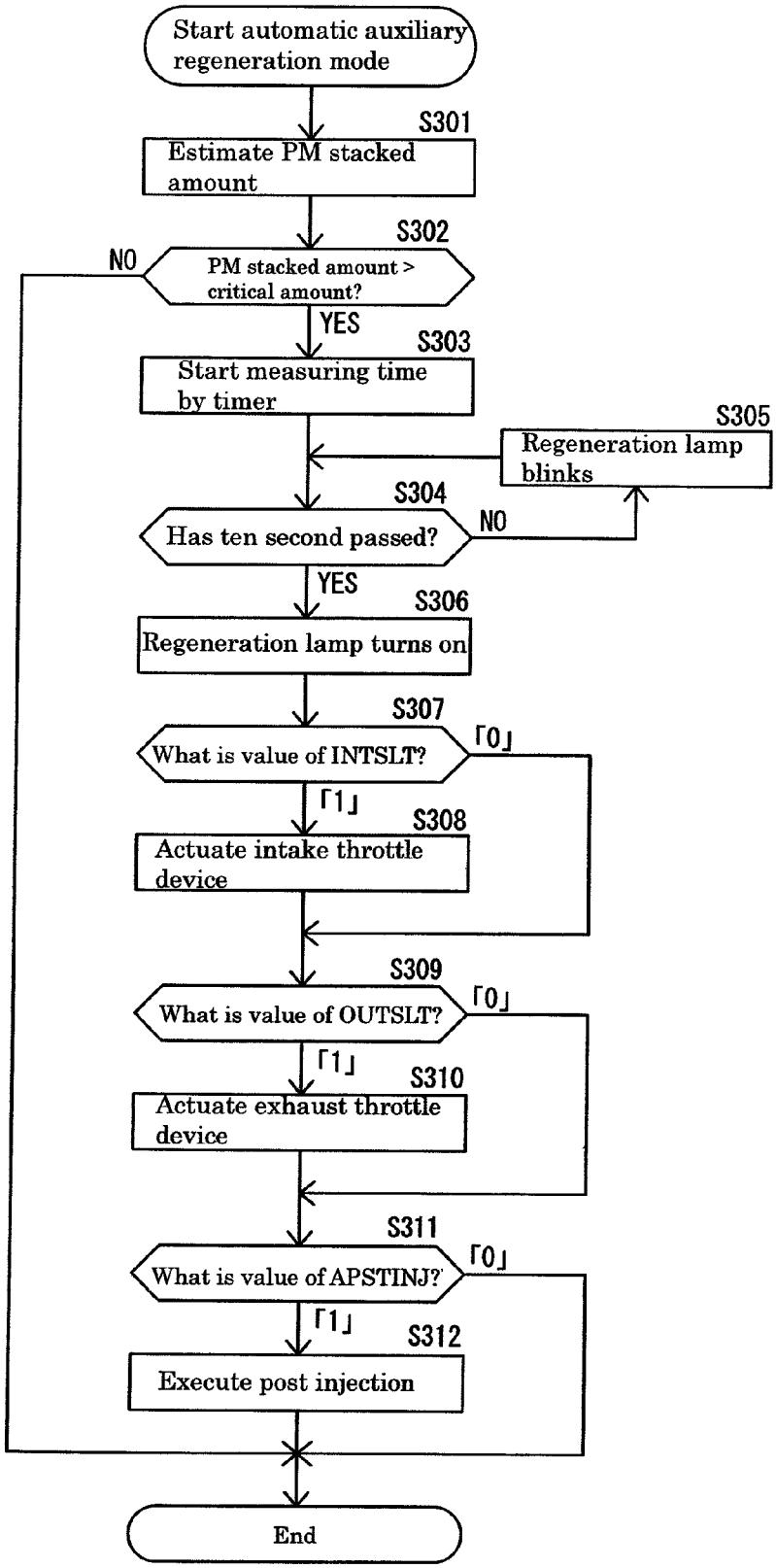
FIG. 9 is a flow chart of the automatic auxiliary regeneration mode.

In the loop process of the second embodiment, since the value of the mode selection flag RGMOD is "1", the step calls the subroutine of the automatic auxiliary regeneration mode shown in FIG. 9 and executes the automatic auxiliary regeneration process (S13). In the subroutine of the automatic auxiliary regeneration mode, first of all, the step estimates the PM stacking amount within the DPF 50 on the basis of a result of detection form the differential pressure sensor 68 (S301), and discriminates whether or not the result of estimation goes beyond a critical amount (a prescribed level) (S302). If it goes beyond the critical amount (S302: YES), the step starts measuring an elapsed time by a timer 35 after the critical amount is exceeded (S303), makes the regeneration lamp 24 blink (S305) until a predetermined time (for example, ten seconds) has passed (S304: NO), and gives the operator notice of the regeneration of the DPF 50.

If the predetermined time has passed (S304: YES), the step finishes the measurement by the timer 35 so as to turn on the regeneration lamp 24 (S306), and discriminates a value of an intake throttle flag INTSLT in the flag table FT2 for the automatic auxiliary regeneration which is read out of the EEPROM 33 (S307). In the second embodiment, since the intake throttle device 81 is provided and INSTLT="1" is established, the step closes an opening degree of the intake throttle device 81 to a predetermined opening degree to limit an intake amount to each of the cylinders (S308). Thereafter, the step discriminates a value of an exhaust throttle flag OUTSLT (S309). In the second embodiment, since the exhaust throttle device 82 is provided and OUTSLT="1" is established, the step closes an opening degree of the exhaust throttle device 82 to a predetermined opening degree to suppress a discharge of the exhaust gas (S310).

Next, the step discriminates a value of a post injection flag APSTINJ (S311). In this case, the post injection means a fuel injection which is carried out after the main injection for feeding a high-pressure fuel to the exhaust route. Since the high-pressure fuel fed to the exhaust route mainly burns the PM within the DPF 50, it is possible to regenerate the DPF 50. In the second embodiment, since the common rail 120 is provided as the fuel injection device and APSTINJ="1" is established, the post injection is executed by the common rail 120 (S312). As mentioned above, in the automatic regeneration auxiliary mode, the temperature of the exhaust gas is raised by increasing the engine load on the basis of the limit of the intake amount and the exhaust amount, or the PM within the DPF 50 is directly burned by the post injection. As a result, the PM within the DPF 50 is removed, and the PM collecting capacity of the DPF 50 (the soot filter 54) is recovered.

Thereafter, the step returns to the main routine of the loop process, and again discriminates the value of the mode selection flag RGMOD (S15). In this case, since RGMOD="1" is established, the step calls a subroutine shown in FIG. 11B, and executes a second trouble diagnosis process (S17). In the second embodiment, since both the intake and exhaust throttle devices 81 and 82 are provided, the step discriminates the value of the intake throttle flag INTSLT in the second trouble diagnosis process (S501). Since INTSLT="1" is established in this case, the step executes a trouble diagnosis of the intake throttle device 81 (S502). Next, the step discriminates the value of the exhaust throttle flag OUTSLT (S503). Since OUTSLT="1" is established in this case, the step executes a trouble diagnosis of the intake throttle device 81 (S504). As the trouble diagnosis of each of the throttle devices 81 and 82, it may be carried out, for example, by actuating each of the throttle devices 81 and 82 so as to open and close, and checking whether or not the actuating state is normal. Thereafter, the step returns to the main routine of the loop process to be finished.

(6) Third Embodiment of Loop Process

Next, a description will be given of a third embodiment of loop process of the DPF regeneration control by the ECU 11 with reference to a flow chart in FIG. 10. The third embodiment shows a case that the engine 70 is mounted to the working machine (for example, the hydraulic shovel or the like) of the type that executes the manual auxiliary regeneration mode. In the manual auxiliary regeneration mode, since the regeneration of the DPF 50 is allowed on the basis of the turn-on operation of the regeneration switch 21, the engine device in accordance with the third embodiment is provided not only with the intake and exhaust throttle devicees 81 and 82, but also with the regeneration switch 21.

In the loop process in accordance with the third embodiment, since the value of the mode selection flag RGMOD is "2", the step calls the subroutine of the manual auxiliary regeneration mode shown in FIG. 10 and executes the manual auxiliary regeneration process (S14). In the subroutine of the manual auxiliary regeneration mode, the step first of all estimates the PM stacked amount within the DPF 50 on the basis of the result of detection from the differential pressure sensor 68 (S401), and discriminates whether or not the result of estimation goes beyond the critical amount (the prescribed level) (S402). If it goes beyond the critical amount (S402: YES), the step makes the regeneration lamp 24 blink (S403), and informs the operator of the fact that the clogged state of the DPF 50 goes beyond the critical amount.

Next, if the regeneration switch 24 is turned on (S404: YES), the step turns on the regeneration lamp 24 (S405), and discriminates the value of the intake throttle flag INTSLT in the flag table FT3 for the manual auxiliary regeneration which is read from the EEPROM 33 (S406). Since the flow of the steps S406 to S411 is the same as the flow of the steps S307 to S312 of the automatic auxiliary regeneration mode which is described in the second embodiment, a detailed description thereof will be omitted. After the step S411, the step returns to the main routine of the loop process, and discriminates again the value of the mode selection flag RGMOD (S15). Since RGMOD="2" is established in this case, the step calls the subroutine shown in FIG. 11B, and executes the second trouble diagnosis process (S17). Thereafter, the step returns to the main routine of the loop process and finishes.

(7) Summary

As is apparent from the description mentioned above and FIG. 1 to FIG. 7, in the engine device, there are provided the exhaust gas purifying device 50 which is arranged in the exhaust route of the engine 70, and the ECU 11 which controls the drive of the engine 70, the engine device is provided with the variable memory means 33 which stores the general-purpose regeneration program GPM selectively executing any of a plurality of regeneration modes with respect to the exhaust gas purifying device 50 and the flag table FT corresponding to the optional regeneration mode, and is rewritable, and the ECU 11 executes the general-purpose regeneration program GPM in accordance with the regeneration mode which is selected on the basis of the flag table FT. Accordingly, it is possible to correspond to the different regeneration modes per kind of the working machines, only by changing the flag table FT in one kind of the general-purpose regeneration program GPM. In accordance with this, it is possible to achieve such an effect that a common use (a common specification) of the ECU 11 can be achieved with respect to the various working machines. In other words, it is possible to achieve an effect that an advantage of an improvement of the general purpose property of the ECU 11 and an advantage of ensuring adequacy with respect to each of the regeneration modes of the ECU 11 are compatible.

Further, it is not necessary to develop the program for regenerating the exhaust gas purifying device 50 per kind of the various working machine, and there is an advantage that it contributes to cost suppression. Further, since the general-purpose regeneration program GPM can be easily switched to one which corresponds to the kind of the working machine only by changing the flag table FT without any special knowledge of a programming, it becomes easy to provide an engine device which meets a customer's (an engine buying manufacture's) demand.

As is apparent from the description mentioned above and FIG. 1 to FIG. 6, the fixed memory means 32 which fixedly stores the flag table FT is provided, and the flag table FT stored in the fixed memory means 32 is written in the variable memory means 33 at the first accessing time of the fixed memory means 32 and the variable memory means 33. Accordingly, it is possible to easily execute the DPF regeneration control in accordance with a different regeneration mode from an initial setting, by later rewriting the flag table FT which is stored in the variable memory means 33. Therefore, in the case that it is intended to change the regeneration mode, it is not necessary to delete the flag table FT each time, for example, by changing the fixed memory means 32, or to rewrite the general-purpose regeneration program GPM, and there is obtained such an effect that it is easy to cope with the systems of the various working machines. For example, for the customer, it is easy to modify a setting to one which is suitable for its own specification in spite of the engine 70 which is bought externally.

As is apparent from the description mentioned above and FIG. 1 to FIG. 10, a plurality of regeneration modes are provided with at least the self regeneration mode which drives the engine 70 under the condition that the exhaust gas purifying device 50 is regenerable, the automatic auxiliary regeneration mode which automatically raises the temperature of the exhaust gas in the case that the clogged degree of the exhaust gas purifying device 50 goes beyond the prescribed level, and the manual auxiliary regeneration mode which allows the regeneration of the exhaust gas purifying device 50 on the basis of the turn-on operation of the manual operating means 24. Accordingly, with the system of the one kind of engine device, it is possible to cope with a plurality of regeneration modes which are suitable for the various types of working machines. Therefore, there can be obtained such an effect that it is possible to further improve a customer satisfaction.

As is apparent from the description mentioned above and FIG. 1 to FIG. 11, necessity of the trouble diagnosis of the engine auxiliary machines 81 and 82 which are relevant to the regeneration of the exhaust gas purifying device 50 is determined in correspondence to the flag table FT, at a time of executing the general-purpose regeneration program GPM. Accordingly, even if the engine auxiliary machines 81 and 82 are provided or not on the basis of the difference of the regeneration mode, it is possible to execute the trouble diagnosis of the engine auxiliary machines 81 and 82 in the case that it is necessary, only by one kind of the general-purpose regeneration program GPM, and it is possible to omit the trouble diagnosis of the engine auxiliary machines 81 and 82 in the case that it is not necessary. In other words, there can be obtained such an effect that the execution and the omit of the trouble diagnosis can be easily switched in correspondence to whether or not the engine auxiliary machines 81 and 82 are provided, without any detail-oriented setting and operation.

(8) Others

The present invention is not limited to the embodiment mentioned above, but can be specified into various aspects. For example, the fuel injection device of the engine device is not limited to the common rail type, but may be of an electronic governor type. In addition, the structure of each of the portions is not limited to the illustrated embodiment, but can be variously changed in a range which does not deviate from the scope of the present invention.

REFERENCE SIGNS LIST

FT Flag table

GPM General-purpose regeneration program

11 ECU

21 Regeneration switch (manual operating means)

24 Regeneration lamp

31 CPU

32 ROM (fixed memory means)

33 EEPROM (variable memory means)

50 DPF (exhaust gas purifying device)

70 Engine

120 Common rail

The invention claimed is:

1. An engine device comprising:

an exhaust gas purifying device arranged in an exhaust route of an engine;

an ECU for controlling a drive of the engine, and an engine auxiliary machine which is relevant to the regeneration of the exhaust gas purifying device, wherein the engine device comprises a variable memory means which stores a general-purpose regeneration program selectively executing any of a plurality of regeneration modes with respect to the exhaust gas purifying device, and a flag table corresponding to an optional regeneration mode, the flag table recording a yes/no value of an operation of said engine auxiliary machine applicable for each one of said plurality of regeneration modes, and the ECU executes the general-purpose regeneration program in accordance with the regeneration mode which is selected on the basis of the flag table.

2. The engine device according to claim 1, comprising a fixed memory means which fixedly stores the flag table, and the flag table stored in the fixed memory means is written in the variable memory means at a first accessing time of the fixed memory means and the variable memory means.

3. The engine device according to claim 2, comprising a plurality of regeneration modes are provided with at least a self regeneration mode which drives the engine under a condition that the exhaust gas purifying device is regenerable, an automatic auxiliary regeneration mode which automatically raises the temperature of the exhaust gas in the case that a clogged degree of the exhaust gas purifying device goes beyond a prescribed level, and a manual auxiliary regeneration mode which allows the regeneration of the exhaust gas purifying device on the basis of a turn-on operation of a manual operating means.

4. The engine device according to claim 1, wherein at a time of executing the general-purpose regeneration program a yes/no value of a trouble diagnosis of the engine auxiliary machine is determined in correspondence to the flag table.

5. The engine device according to claim 1, wherein said flag table comprises:

a first flag that identifies said optional regeneration mode from among said plurality of regeneration modes;

a second flag that indicates a control of the engine auxiliary machine used during said optional regeneration mode; and a third flag that indicates whether post injection is executed during said optional regeneration mode.

6. An engine device comprising:

an exhaust gas purifying device arranged in an exhaust route of an engine;

an ECU for controlling a drive of the engine, and an engine auxiliary machine which is configurable for performing regeneration of the exhaust gas purifying device, wherein the engine device comprises a variable memory means and a flag table;

wherein the variable memory means stores a general-purpose regeneration program selectively executing any of a plurality of regeneration modes with respect to the exhaust gas purifying device, wherein the flag table is configurable for each one regeneration mode of the plurality of regeneration modes to identify said one regeneration mode and to store a value applicable to said one regeneration mode, wherein the flag table records said value as a yes/no value of an operation of said engine auxiliary machine applicable to said one regeneration mode, and wherein the ECU executes the general-purpose regeneration program in accordance with said one regeneration mode identified by said identity for which said flag table is configured.

7. The engine device according to claim 6, wherein said flag table comprises:

a first flag that identifies said one regeneration mode;

a second flag that indicates a control of the engine auxiliary machine used during said one regeneration mode; and a third flag that indicates whether post injection is executed during said one regeneration mode.

8. The engine device according to claim 6, further comprising:

a fixed memory means which fixedly stores a first plurality of flag tables including a respective flag table for each one of said plurality of regeneration modes; and wherein a first flag table among said first plurality of flag tables is written as said flag table for said one regeneration mode in said variable memory means at a first accessing time of the fixed memory means and the variable memory means.

9. The engine device according to claim 8, wherein said plurality of regeneration modes comprise:

a self regeneration mode which drives the engine under a condition that the exhaust gas purifying device is regenerable, an automatic auxiliary regeneration mode which automatically raises the temperature of the exhaust gas in the case that a clogged degree of the exhaust gas purifying device goes beyond a prescribed level, and a manual auxiliary regeneration mode which allows the regeneration of the exhaust gas purifying device on the basis of a turn-on operation of a manual operating means.

* * * * *